US008677657B2

(12) United States Patent
Bacon et al.

(10) Patent No.: US 8,677,657 B2
(45) Date of Patent: Mar. 25, 2014

(54) GOLF SHOE OUTSOLE

(75) Inventors: Jonathan G. Bacon, Westford, MA (US); John J. Erickson, Brockton, MA (US); Douglas K. Robinson, Mansfield, MA (US); James M. Feeney, Marion, MA (US); Robert S Bento, Raynham, MA (US)

(73) Assignee: Acushnet Company, Fairhaven, MA (US)

( * ) Notice: Subject to any disclaimer, the term of this patent is extended or adjusted under 35 U.S.C. 154(b) by 147 days.

(21) Appl. No.: 13/105,944

(22) Filed: May 12, 2011

(65) Prior Publication Data

US 2012/0285044 A1 Nov. 15, 2012

(51) Int. Cl.
*A43B 5/00* (2006.01)
*A43B 13/00* (2006.01)

(52) U.S. Cl.
USPC ..... 36/127; 36/134; 36/103

(58) Field of Classification Search
USPC ..... 36/126–129, 103, 134, 25 R
See application file for complete search history.

(56) References Cited

U.S. PATENT DOCUMENTS

| | | | | |
|---|---|---|---|---|
| 2,071,431 | A | | 2/1937 | Riddell |
| 4,161,828 | A | | 7/1979 | Benseler et al. |
| 4,255,877 | A | | 3/1981 | Bowerman |
| 4,259,792 | A | | 4/1981 | Halberstadt |
| 4,322,895 | A | | 4/1982 | Hockerson |
| 4,550,510 | A | * | 11/1985 | Stubblefield ..... 36/32 R |
| 4,741,114 | A | | 5/1988 | Stubblefield |
| 4,858,343 | A | * | 8/1989 | Flemming ..... 36/128 |
| 5,079,856 | A | * | 1/1992 | Truelsen ..... 36/25 R |
| 5,628,129 | A | * | 5/1997 | Kilgore et al. ..... 36/134 |
| 5,797,199 | A | * | 8/1998 | Miller et al. ..... 36/28 |
| 5,979,083 | A | * | 11/1999 | Robinson et al. ..... 36/127 |
| 6,289,611 | B1 | * | 9/2001 | Patterson et al. ..... 36/127 |
| 6,438,870 | B2 | * | 8/2002 | Nasako et al. ..... 36/28 |
| 6,629,376 | B1 | | 10/2003 | Ellis, III |
| 6,634,121 | B2 | * | 10/2003 | Sordi ..... 36/102 |
| 6,793,996 | B1 | * | 9/2004 | Umezawa ..... 428/36.8 |
| 6,817,117 | B1 | | 11/2004 | Campbell |
| 7,010,869 | B1 | * | 3/2006 | Ellis, III ..... 36/25 R |
| D530,892 | S | * | 10/2006 | Issler ..... D2/954 |
| D533,335 | S | * | 12/2006 | Robinson et al. ..... D2/959 |
| 7,428,790 | B2 | * | 9/2008 | Pellerin ..... 36/134 |
| 7,441,346 | B2 | * | 10/2008 | Hardy et al. ..... 36/25 R |
| D593,736 | S | * | 6/2009 | Mochen et al. ..... D2/954 |
| 2009/0013561 | A1 | | 1/2009 | Robinson, Jr. et al. |

* cited by examiner

*Primary Examiner* — Jila M Mohandesi
(74) *Attorney, Agent, or Firm* — Daniel W. Sullivan

(57) ABSTRACT

The golf shoe outsole of the invention has a generally flexible forward section and a generally hard heel section, each section having a plurality of pod sections molded thereupon, each pod section having at least one cleat attached thereto. and an outer edge or perimeter that is flared quite significantly to provide a greater degree of flexibility and traction with turf, and therefore greater stability and balance to the user.

7 Claims, 3 Drawing Sheets

GOLF SHOE OUTSOLE

FIELD OF THE INVENTION

The present invention is directed to a golf shoe. More particularly, the present invention is directed to a golf shoe utilizing flared stability pods to enable greater flexibility, balance, and traction for the golfer.

BACKGROUND OF THE INVENTION

Historically, people first wore shoes to protect their feet. Over the centuries, footwear evolved into many different types that were specific to particular activities. Thus, the protection offered by a cold-weather work boot is highly different from that offered by a running shoe. In addition to protecting the feet, athletic footwear has further developed to offer specific functions dependent on the particular sport. Soccer shoes, for instance, have spikes for traction, whereas cycling shoes have very stiff soles with mounting plates for cleats to engage the pedal. In this manner, golf shoes have evolved to provide the wearer with good traction on grass, comfort while walking, and a stable platform for hitting the ball. Typical golf shoes have had a relatively stiff sole with metal spikes or plastic cleats.

A stiff sole, while providing a stable platform, can nonetheless cause discomfort because there is a balance between how the foot should be allowed to move versus how it should be supported. An example of this is the fact that during walking and at the start and finish of the golf swing, the foot bends at the metatarsal joints (the ball). Aside from the physical effort needed to flex a very stiff sole (which would tend to cause a 'clunky' gait as when wearing clogs), sole stiffness tends to cause the heel of the foot to slide up and down in the heel cup, potentially causing blisters. Thus, golf shoes have evolved to have soles that flex across the ball area to allow this movement without compromising the lateral stability of a good hitting platform.

However, relatively recent studies in biomechanics have sought to better quantify how the 26 bones of the foot move relative to each other during human movements. One particular motion that has been identified is a torsional movement about the long axis of the foot. In effect, the forefoot and rear foot twist relative to each other. It is thought that this movement smoothes the contact between foot and ground, decreasing impacts with the ground as well as providing better ground contact. This observation has led to the development of a golf shoe sole to allow this natural movement.

U.S. Pat. No. 3,550,597 discloses a device that facilitates the natural rolling action of the foot during movement by providing a flat construction with front and rear main lifting sections rigidly connected to a resilient intermediate section that is twisted into the form of a flat torsion spring. The device applies a yieldable torsion action during use that is applied to the foot by the lifting sections, whereby the heel of the foot is urged upwardly at the inner side and the forefoot is raised upwardly at the outer side, producing a torsion action similar to the natural torsion action of the foot.

Another construction intended to provide greater support to the wearer of the shoe is disclosed in U.S. Pat. No. 5,926,974 to Friton. The Friton shoe has a sole that is not designed for golf, but for hiking. It discloses the use of pods and lugs for traction elements that in combination provide greater traction or irregular ground conditions. However, the teachings of this patent are atypical of what is required for a golf shoe. Patent '974 discloses a plurality of pods that are relatively soft, such that they may fan out and serve as compression cushions therein increasing the area of ground contact to improve traction, much the way the hoofs of a mountain goat react. The present invention utilizes relatively hard pods for an entirely different type of terrain.

There remains a need for an improved outsole for a golf shoe that enables an individual movement of the foot, particularly, the rotation between the rear foot and the forefoot, flexing across the foot of the wearer, and also the ability of the shoe to provide flexibility not just across but longitudinally along the metatarsal area of the foot.

SUMMARY OF THE INVENTION

The present invention provides a golf shoe outsole that comprises a generally flexible forward section and a generally hard heel section, each section having a plurality of pod sections molded thereupon, preferably there are eight separate pod sections, each having at least one cleat attached thereto. Each pod section has an outer edge or perimeter that is flared quite significantly from any shoe seen in the art. The purpose of the dramatic flare angles is that the attached golf shoe will have a greater degree of flexibility and traction with turf, and therefore greater stability and balance to the user.

One embodiment has an outsole exhibiting a 0.375 width to length ratio at the metatarsal area of the outsole. At the C1-C2 cross-section of the outsole the ration is 0.365 and at the D1-D2 cross-section the ration is still 0.333.

An embodiment of the invention provides for the outsole to flare up to 52° from vertical on the outer edges of the pods. The pods are relatively hard with a minimum Shore A hardness of 95 and extend a minimum of 6.3 mm from the bottom surface of the outsole. The forward portion of the outsole is made from a relatively flexible thermoplastic polyurethane having a hardness between 75 to 85 Shore A.

BRIEF DESCRIPTION OF THE DRAWINGS

To facilitate the understanding of the characteristics of the invention, the following drawings have been provided wherein.

DETAILED DESCRIPTION OF THE PREFERRED EMBODIMENTS

Figure 1:
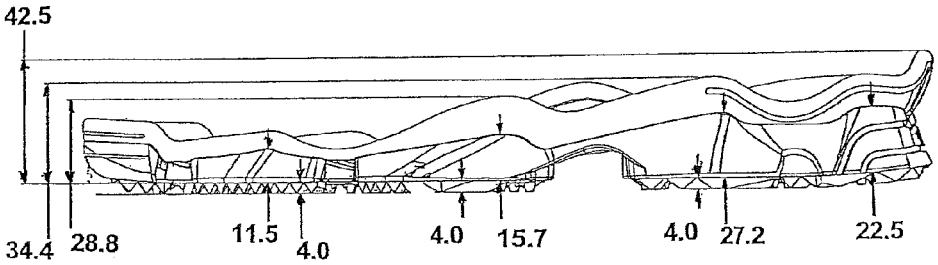
FIG. 1 is an elevated right side view of the outsole of the invention.

Shown in FIGS. 1-8, is a golf outsole 30. Not shown are the other portions of a golf shoe usually includes an upper portion, and a mid-sole that is sandwiched between the upper and the outsole. Golf shoes usually have cleats which can be metal or non-metal, but in discussing the present invention it is to be assumed that only non-metal cleats will be employed. Golf shoe upper portions usually are formed from a suitable upper material, such as leather or the like. The mid-sole provides cushioning to the wearer, and is usually formed of a material such as an ethylene vinyl acetate copolymer (EVA). Midsoles may be formed on and about outsole 30, but can be formed separately from the outsole 30 and joined thereto such as by adhesive. The outsole 30 forms a substantial portion of the bottom of a golf shoe. The upper portion of the shoe is preferably secured to the mid-sole with cement or other adhesives using an insole board and conventional techniques as known by those of ordinary skill in the art.

An embodiment of the invention has an improved outsole 30 which includes relatively hard thermoplastic polyurethane (TPU) pod sections 31*a*-31*e* molded to a relatively soft and flexible TPU forward portion 32. Pod sections 31*g*-31*h* are molded to the heel portion 35 of the shoe. The pod sections and foot portions are shown in FIGS. 2-5. Each pod section contains a receptacle 33 for inserting or removing a turf gripping cleat (not shown). The cleat receptacle only requires a 45° clockwise twist turn to attach the cleat, and a 45° reverse turn to release it. Turf gripping cleats provide increased traction and balance for the golfer especially when the golfer executes a golf shot. The number of pods and cleats are a function of the shoe style but preferably the number of pods on each shoe is between seven and nine, preferably nine as shown in the drawings herein, with five on the forward portion 32 and four on the rear section. Cleats are preferably non-metallic as most golf courses now make that a requirement for course play. An arch support shank section 34 extends from the arch to the rear 36 of the outsole 30.

In the preferred embodiment, the forward portion 32 may be formed of flexible plastic material such as thermoplastic polyurethane as manufactured by URE-TECH CO, LTD located in Taiwan under the name Utechllan UTY-75A-85A with a durometer of about 75 to 85 Shore A hardness. The pod sections 31*a*-*h* are made of a relatively hard, wear resistant polyurethane material manufactured by Ure-Tech and have a hardness of at least 95 A. The outer ends of each pod section 31*a*-*h* extend a minimum distance of at least 6.3 mm from the bottom surface of the forward or rear portions 32, 35. Pod sections 31*a*-*h*, as best shown on FIGS. 2-6, are of varying dimensions, and are spaced to allow the forward portion 32 the ability to flex across the metatarsal region. As previously stated, each pod has a cleat attached in a releasing manner that provides a measure of traction, which is supplemented by a multitude of relatively hard projections 36 protruding from the bottom surface of each pod. The arch support shank 34 is made of a hard plastic having a hardness of at least 95.

Figure 2:
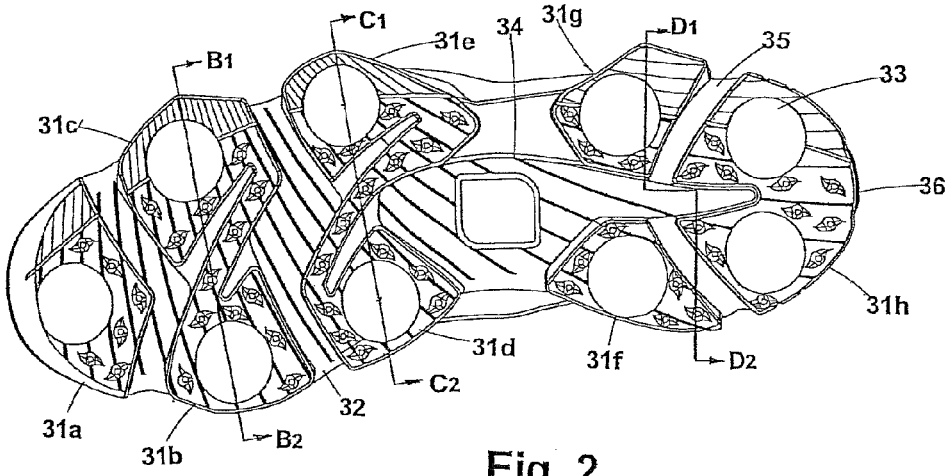
FIG. 2 is a bottom, plan view of the invention.
Figure 3:
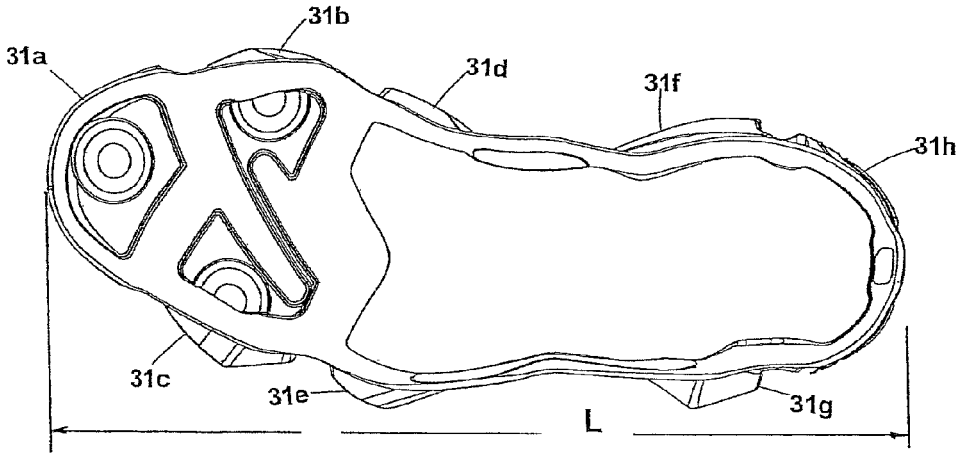
FIG. 3 is a top plan view showing width to length ratios of the outsole of the invention.
Figure 4:
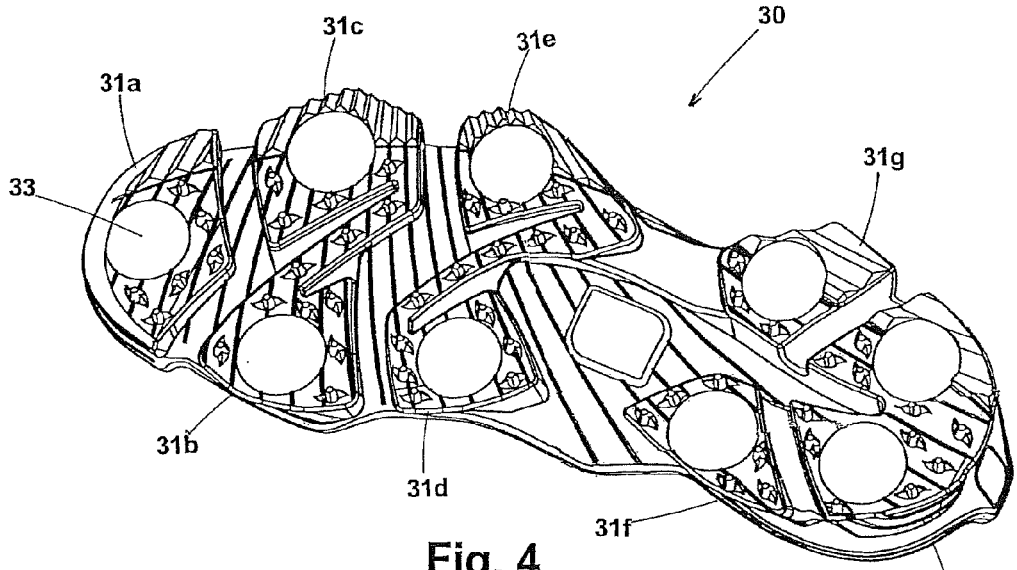
FIG. 4 is a bottom pictorial view of the outsole.
Figure 5:
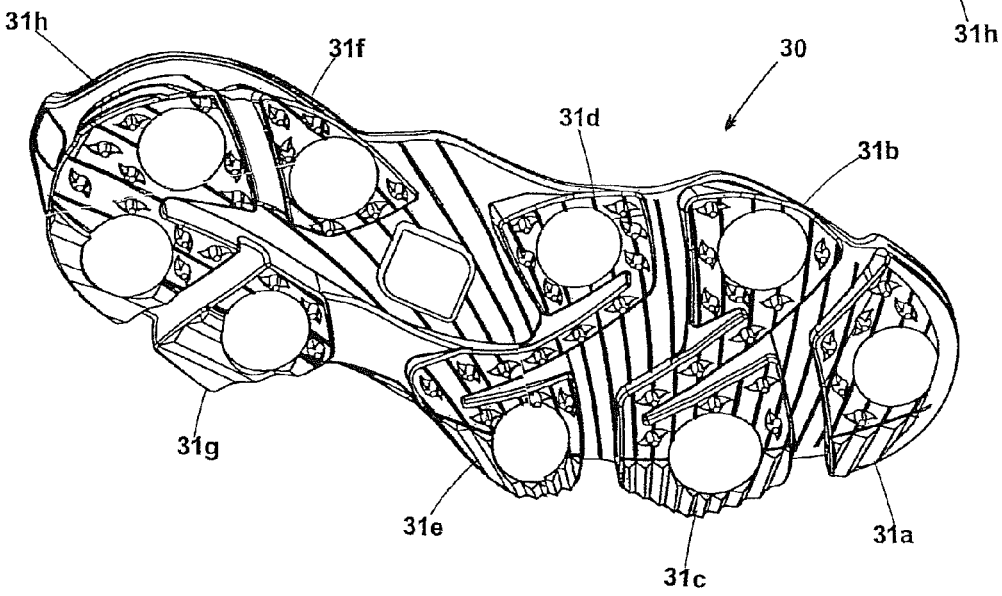
FIG. 5 is a bottom pictorial view of the outsole.

The creative improvement of the present invention is found in the novel construction of the pod sections 31*a*-*h*, specifically in the way their exterior surfaces are flared away from what would be a normal contour of the outsole. This allows the pod sections 31*a*-*h* to provide greater stability and support during the golf swing. This is especially relevant when the ground conditions are wet or soft. The purpose is to allow the golfer to be more connected to the ground and prevent "roll over" on the outside of the right foot. (All comments made to the swing assume a right-handed golfer.) The present invention provides greater stability for golfers who have a tendency to sway on the backswing, and this also allows a more stable transition of the golfer's weight from the right side to the left side, therein more balance all the way to the completion of the follow through. The width of the shoe in relationship to the overall length is one of the critical parameters for providing stability during the golf swing. The shoe of the present invention exhibits great width to depth ratios at all the key positions of the outsole 30. FIGS. 2-3 illustrate the extent in which extra width is provided to the outsole by the pod sections flaring in an outward direction. For a typical 9.5 M size shoe, as shown in FIGS. 2-3 and 6-8, the length L of the shoe is 304.8 mm, and the width XB across section B1-B2 is 114.3 mm for an X/L ratio of 0.375. The width XC across the shoe at section C1-C2 is 111.1 mm for an X/L ratio of 0.365, and at section D1-D2 the width XD is 101.6 mm for an X/L ratio of 0.333. The ratio being greater at the metatarsal area of the shoe which is where stability during the golf swing is most critical.

Figure 6:
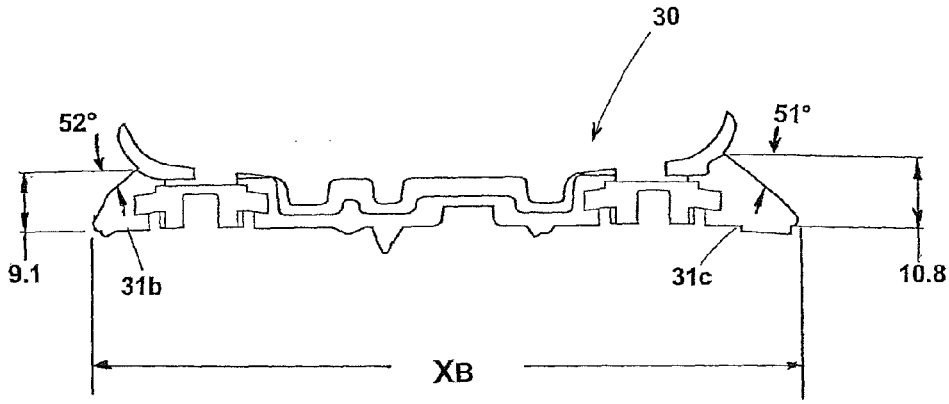
FIG. 6 is a cross-section of the outsole taken across B1-B2 of FIG. 2.
Figure 7:
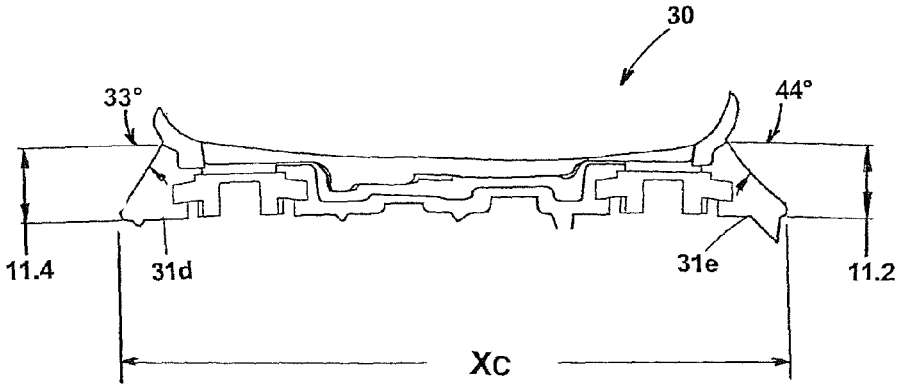
FIG. 7 is a cross-section of the outsole taken across C1-C2 of FIG. 2.
Figure 8:
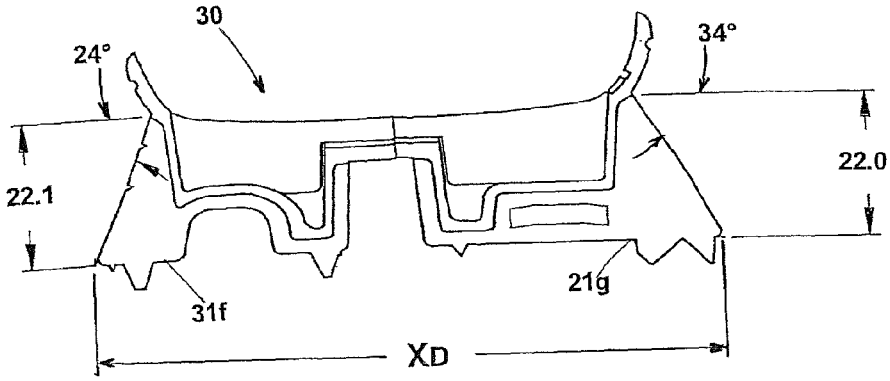
FIG. 8 is a cross-section of the outsole taken across D1-D2 of FIG. 2.

To achieve stability in the golf shoe of the present invention the outsole comprises pod sections 31*a*-*h* which have their outer perimeters flared from vertical as best shown in FIGS. 6-8. In FIG. 6, the pod section 31*b* is flared at 52° from vertical with a vertical height of 9.1 mm, while the pod section 31*c* flares about 51° from vertical with a height of 10.8 mm. In FIG. 7 pod section 31*d* exhibits a flare of 33° from vertical at a vertical height of 11.4 mm, while pod section 31*e* has an outer edge flaring about 44° from vertical at a height of 11.2 mm. FIG. 8 depicts pod section 31*f* flaring 24° from vertical with a vertical height of 22.1 mm, while pod section 31*g* flares 34° from vertical with a height of 22 mm. While it is known that some athletic shoes exhibit a slight flare, these shoes have generally restricted the flaring to the heel area and never from a pod section or any flare angles approaching the flare angles of the present invention.

While it is apparent that the invention herein disclosed is well calculated to fulfill the objects above stated, it will be appreciated that modifications and embodiments may be devised by those skilled in the art. For example, the outsole 30 and other features thereof discussed above may be used with other types of shoes, not just golf shoes. The appended claims cover all such modifications and embodiments as fall within the true spirit and scope of the present invention.

What is claimed is:

1. A golf shoe outsole comprising:

a plurality of pod sections molded to a bottom surface of the outsole; and each pod section having a flared outer perimeter extending beyond the normal contour of the outsole, the outsole having metatarsal and heel portion cross-sections, wherein at the metatarsal cross-section, a ratio of width to length is about 0.375 and the pod sections have a flare angle of about 52° on the medial side of the outsole and about 51° on the lateral side of the outsole, and wherein at the heel cross-section, a ratio of width to length is about 0.333 and the pod sections have a flare angle of about 22° on the medial side of the outsole and about 34 ° on the lateral side, and wherein the shoe will have a greater degree of flexibility and traction with turf, and therefore greater stability and balance to the user.

2. The shoe outsole of claim 1, wherein the pods have a minimum Shore A hardness of 95.

3. The shoe outsole of claim 1, wherein the pods have outer ends that extend at least 63 mm from a bottom surface of the forward or rear portion of the outsole.

4. The shoe outsole of claim 1, wherein the forward section is made from relatively thin flexible thermoplastic polyurethane having a hardness between 75 to 85 Shore A.

5. The shoe outsole of claim 1, wherein each pod has a receptacle for attaching and removing a cleat.

6. The shoe outsole claim 1, wherein there are five pods molded to the forward section and four pods molded to the rear section.

7. A golf shoe outsole consisting of:

a plurality of pod sections molded to a bottom surface of the outsole and extending a minimum of about 6.33 mm from the surface;

each pod section having a flared outer perimeter extending beyond the normal contour of the outsole, the outsole having metatarsal and heel portion cross-sections, wherein at the metatarsal cross-section, a ratio of width to length is about 0.375, and the pod sections have a vertical height of about 9.1 mm and a minimum flare angle of about 52° on the medial side of the outsole; and a minimum vertical height of about 10.8 mm and a minimum flare angle of about 51° on the lateral side of the outsole; and wherein at the heel cross-section, a ratio of width to length is about 0.333 and the pod sections have a vertical height of about 22.1 mm and a flare angle of about 24° on the medial side of the outsole and a vertical height of about 22 mm and a flare angle of about 34° on the lateral side of the outsole, and wherein the shoe will have a greater degree of flexibility and traction, with turf, and therefore greater stability and balance to the user.

* * * * *